US006424815B1

(12) United States Patent
Kawamoto et al.

(10) Patent No.: US 6,424,815 B1
(45) Date of Patent: Jul. 23, 2002

(54) OIL COATING ROLLER, OIL COATING DEVICE, AND FIXING APPARATUS

(75) Inventors: Hideo Kawamoto, Tokyo; Kazuo Kishino, Kanagawa; Masaaki Takahashi, Saitama; Jiro Ishizuka, Shizuoka; Osamu Sotome; Yuji Kitano, both of Kanagawa, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/680,973

(22) Filed: Oct. 6, 2000

(30) Foreign Application Priority Data

Oct. 14, 1999 (JP) ..... 11-292600
Sep. 5, 2000 (JP) ..... 2000/268723

(51) Int. Cl.[7] ..... G03G 15/20
(52) U.S. Cl. ..... 399/325
(58) Field of Search ..... 399/325, 324, 399/326, 327; 219/216, 469; 428/36.9, 41.4; 492/48, 53, 56, 59; 118/60, DIG. 1, 258, 261

(56) References Cited

U.S. PATENT DOCUMENTS 4,580,033 A * 4/1986 Sakurai ..... 219/216
5,319,427 A 6/1994 Sakurai et al. ..... 399/333
5,364,697 A * 11/1994 Miyabayashi ..... 118/60 X
5,420,679 A 5/1995 Goto et al. ..... 399/335
5,563,695 A 10/1996 Sakurai et al. ..... 399/327
5,608,508 A 3/1997 Kumagai et al. ..... 399/339
5,717,988 A 2/1998 Jinzai et al. ..... 399/333
5,725,922 A * 3/1998 Nakamura et al. ..... 428/36.9
5,729,818 A 3/1998 Ishizuka et al. ..... 399/400
5,803,887 A * 9/1998 Fukunaga ..... 492/59
5,950,061 A 9/1999 Ota et al. ..... 399/333
5,966,578 A 10/1999 Soutome et al. ..... 399/333
6,070,045 A * 5/2000 Hara et al. ..... 399/325

FOREIGN PATENT DOCUMENTS

JP 61-88285 5/1986
JP 7-15606 2/1995
JP 10-228205 8/1998

* cited by examiner

*Primary Examiner*—Sophia S. Chen
*Assistant Examiner*—Hoan Tran
(74) *Attorney, Agent, or Firm*—Fitzpatrick, Cella, Harper & Scinto

(57) ABSTRACT

An oil coating roller is provided which has superior releasing properties and will not abrade an edge portion of an oil control blade. In the oil coating roller having a topmost exterior layer composed of a silicone rubber layer, the silicone rubber layer contains 0 to 0.5 part by weight of an inorganic filler having a predetermined average particle diameter to 100 parts by weight of a silicone rubber, and the tensile strength of the silicone rubber layer is 1.0 MPa or more. In addition, the surface roughness (Rz) of the silicone rubber layer is 0.5 to 20 $\mu$m.

22 Claims, 2 Drawing Sheets

OIL COATING ROLLER, OIL COATING DEVICE, AND FIXING APPARATUS

BACKGROUND OF THE INVENTION

1. Field of the Invention

The present invention relates to oil coating rollers for coating silicone oils as releasing agents on surfaces of fixing rollers in thermal fixing apparatuses for use in electrophotographic copying machines, laser printers, and the like.

2. Description of the Related Art

In electrophotographic processes represented by electrophotographic copying machines, toner images on copy paper are fixed by a thermal roller method. In the thermal roller method, a nip is formed by a fixing roller and a pressure roller, images formed by toner on copy paper are passed through the nip and are then heated and pressed, thereby fixing the toner by fusing. In the thermal roller method, in order to prevent toner from remaining on the fixing roller, the toner coming into direct contact therewith, so as to more preferably fix the toner images and decrease staining on a cleaner blade, a cleaner felt, and the like, a silicone oil having superior releasing properties is coated on the fixing roller.

In the case of monochrome images, the toner layer is thinner compared to the case of color images, and the amount of oil coated on a fixing roll can be further decreased concomitant with improvement of the toner itself. However, in the case of color images, since the toner layer is thick, the melting point thereof is low, and the viscosity thereof is high, the image deficiencies (toner offset) due to toner staining are easily generated, and as a result, in order to avoid the image deficiencies mentioned above, a larger amount of a silicone oil must be coated than that in the case of monochrome images.

As methods for coating silicone oil, there may be mentioned a method for coating a silicone oil, which is impregnated in a webbing, or a felt, on a surface of a fixing roller, and a method for coating a silicone oil, which is supplied by an oil coating roller, directly on a surface of a fixing roller. However, when a large amount of silicone oil is necessary as is the case with full-color images, a method for coating silicone oil is preferably performed by using an oil coating roller rather than that performed by using a webbing or a felt.

Conventionally, a topmost exterior layer of the oil coating roller is formed of a solid or a spongy silicone rubber layer. The spongy (foamed) silicone rubber is generally provided with a hollow member or the like therein for supplying a silicone oil, and the silicone oil is leached out on the spongy surface and is then coated, which is disclosed in Japanese Examined Patent Application Publications No. 5-60105, 7-15606, and the like. In the case of the solid (not spongy but solid form) silicone rubber layer, a silicone oil is transferred to an oil coating roller, which is scooped from a silicone oil bath, and it is then coated on a surface of a fixing roller by directly contacting the oil coating roller with the surface of the fixing roller. In addition, an oil-coating roller is disclosed in Japanese Unexamined Patent Application Publication No. 10-228205, in which the oil coating roller has the topmost exterior layer composed of a solid silicone rubber layer and a spongy silicone rubber layer provided therein.

In the method described above for coating silicone oil on the surface of the fixing roller by leaching the oil out on the spongy surface of the silicone rubber layer, toner adheres to the spongy surface in long-term use, oil supply is stopped at locations at which the toner adheres, and coating defects of the oil on the fixing roller occur, whereby there may be a problem in some cases in that abnormal images are produced. Accordingly, when an amount of toner offset is relatively large as is the case in which full-color images are fixed, particularly in order to perform stable and consistent oil coating over long periods of time, a method using a solid silicone rubber layer is preferably employed.

In addition, in the method for coating oil using the oil coating roller as described above, as a means for controlling the amount of silicone oil on the oil coating roller so as to be uniform, a method is generally used in which an oil control blade is provided which is urged toward the surface of the oil coating roller so as to maintain a constant pressure thereto by a pressure spring.

However, in conventional oil coating rollers in which the topmost exterior layers are composed of a solid silicone rubber layer, there are problems, which are of concern, as described below.

As a method for improving heat stability and mechanical strength of silicone rubber, a method is well known in which an inorganic filler, such as synthetic hydrated silica or silicate anhydride, is contained in the silicone rubber. However, since a large amount of synthetic hydrated silica, such as 20 to 50 parts by weight thereof to 100 parts by weight of the silicone rubber, must be added to obtain an effect of reinforcement, releasing properties of the silicone rubber may be degraded due to the addition of a large amount of synthetic hydrated silica. Consequently, an amount of offset toner transferred from the surface of the fixing roller is excessively increased, irregular and excessive coating of the oil on the oil coating roller thereby occur, and hence, excessive and irregular coating of the oil occur on the fixing roller, and ultimately, on a recording medium. As a result, it has been of concern that oil sagging, oil staining, oil stripes, and the like may be produced on images. In particular, the phenomena mentioned above may apparently be generated when an OHP sheet is fixed which will not absorb oil.

In addition, in the method for controlling an amount of silicone oil coated on the surface of the fixing roller by contacting an edge portion of the oil control blade urged toward the oil coating roller by a spring or the like, and at the same time, for smoothly and uniformly coating the oil on the oil coating roller, a uniform and desired amount of coating can be obtained at the beginning. However, as operation time passes, the edge portion of the oil control blade and the surface of the oil coating roller abrade each other, and abrasion of the edge portion thereby proceeds, whereby it may be difficult to maintain a stable coating amount of the oil in some cases after long operation time.

That is, in the case in which a coating amount of the oil is indicated by a when the oil control blade is in the initial state, and in the case in which a coating amount of the oil is indicated by b when the abrasion of the oil control blade proceeds, a <<b may occur in some cases. The reason for this is believed to be that the amount of the oil passing through is increased due to the progress in the abrasion of the edge portion of the oil control blade. Consequently, the amount of the oil transferred on the surface of the oil coating roller is excessively increased, and excessive coating on the fixing roller, and ultimately, on the recording media occurs, resulting in oil sagging, oil staining, and oil stripes. As a result, image quality is significantly degraded, and in particular, when images are fixed on an OHP sheet, sticking and degradation of tactile sensation due to excessive oil may occur in some cases.

The excessive coating amount of the oil not only increases consumption of the silicone oil but may also create problems in some cases, for example when double-sided copy is produced, paper supply defects (paper jams) due to slipping of the recording media when refed and cleaning defects, conveying defects, double images, and the like due to adhesion of excessive oil on the recording media on a photosensitive drum, a conveyer roller in a feed passage for conveying the recording media, and a conveyer belt.

On the other hand, in consideration of the increase in the coating amount of the oil due to the abrasion of the edge portion, when the oil control blade is in the initial state, the coating amount of the oil may be set to be less beforehand. In this case, the problems described above can be solved; however, new problems are of concern in which image qualities are significantly degraded. They are, for example, degradation of toner releasing properties due to insufficient coating amount of oil, decrease in life of the fixing roller, and increase in image gloss.

The increase in the coating amount of the oil of the oil coating device concomitant with long-term use is caused by the abrasion of the edge portion of the oil control blade. The abrasion of the edge portion occurs because a hard inorganic filler, which is contained in the silicone rubber layer forming the topmost exterior layer of the oil coating roller, is exposed on the surface thereof.

That is, in order to improve heat stability and mechanical strength, the topmost exterior layer composed of the silicone rubber layer of a conventional oil coating roller contains a large amount of a hard inorganic filler having relatively large diameters, and the inorganic filler is exposed on the surface of the topmost exterior layer. The exposure of the inorganic filler is more significantly observed when the oil coating roller is polished so as to obtain a desired diameter thereof. In addition, since the edge portion of the oil control blade is abraded with the inorganic filler having relatively large diameters exposed on the surface of the topmost exterior layer, the edge portion composed of a soft elastic material may be gradually abraded in some cases. As a result, since the oil passes through at locations at which the oil control blade is abraded, an amount of the oil supplied to the oil coating roller may be gradually increased in some cases. The phenomenon described above is more significant when the content of the inorganic filler is increased, and when the particle diameter thereof is increased.

In addition, the fixing roller may also have the problems described below. That is, when the initial amount of the oil coated on the surface of the fixing roller is insufficient, there may be problems in that the amount of the offset toner is increased, and the life of the fixing roller is decreased. In contrast, when the initial coating amount of the oil exceeds the appropriate range thereof, there may be problems in that color reproducibility of fixed images is degraded, oil staining occurs on recording sheets, tactile sensation of OHP sheets is degraded, and the like. Accordingly, the initial coating amount of the oil must always be controlled in the appropriate range.

As has thus been described, in the oil coating device in which the amount of silicone oil is controlled by the oil control blade which is urged toward the oil coating roller by a spring so as to maintain a constant pressure thereto, as a means for controlling an amount of silicone oil on the oil coating roller, conventionally, a means for adjusting a contacting angle of the oil control blade or a means for adjusting a pressure thereof contacting the oil coating roller are used. However, further improvement thereof has been desired.

SUMMARY OF THE INVENTION

Accordingly, it is an object of the present invention to provide an oil coating roller which has superior releasing properties and will not abrade an edge portion of an oil control blade.

It is another object of the present invention to provide an oil coating device using the oil coating roller described above and a fixing apparatus.

In the oil coating roller according to the present invention having a topmost exterior layer composed of a silicone rubber layer comprising a silicone rubber, the tensile strength of the silicone rubber layer is 1.0 MPa or more, and the silicone rubber layer contains no inorganic filler or contains not more than 0.5 part by weight to 100 parts by weight of the silicone rubber.

In addition, in the oil coating roller according to the present invention having a topmost exterior layer composed of a silicone rubber layer comprising a silicone rubber, the tensile strength of the silicone rubber layer is 1.0 MPa or more, and the silicone rubber layer contains no inorganic filler or contains an inorganic filler having an average particle diameter of less than 10 $\mu$m.

According to the oil coating roller of the present invention, since the tensile strength of the silicone rubber layer is 10 MPa or more, it is not necessary to use a large amount of the inorganic filler having large diameter which causes abrasion of the edge portion of the oil control blade. As a result, long-term stability of the oil coating device can be realized.

In addition, by controlling the surface roughness of the roller surface of the silicone rubber layer in the appropriate range, the initial coating amount of the oil can be controlled in the appropriate range and can be maintained therein.

Furthermore, the fixing apparatus comprising the oil coating device of the present invention can provide stable and superior fixed images over long periods of time.

Further objects, features, and advantages of the present invention will become apparent from the following description of the preferred embodiments with reference to the attached drawings.

DESCRIPTION OF THE PREFERRED EMBODIMENTS

Figure 1:
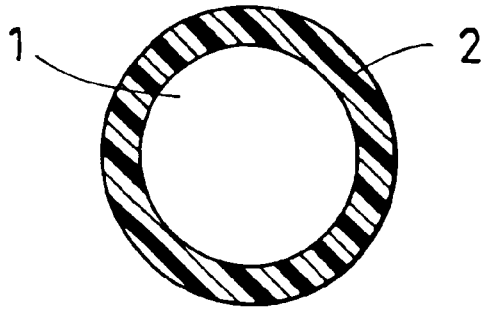
FIG. 1 is a schematic cross-sectional view of an oil coating roller of the present invention.

In an oil coating roller of the present invention, it is preferable that the tensile strength of a silicone rubber layer be 1.0 MPa or more, and that the surface roughness (Rz) thereof be 0.5 to 20 $\mu$m.

In addition, the tensile strength of the silicone rubber is 1.0 MPa or more, preferably 1.5 MPa or more, and even more preferably, 2.0 MPa or more. Since a pure rubber composed of a siloxane polymer, which has a low intermolecular cohesion, has a low mechanical strength, such as 0.3 to 0.5 MPa, in order to realize the tensile strength mentioned above, a considerable amount of an inorganic filler must be added to the silicone rubber.

However, the inventors of the present invention discovered that, by using a component having a superior mechanical strength as a silicone rubber contained in the silicone rubber layer, a silicone rubber layer having a mechanical strength of 1.0 MPa or more could be obtained without adding a considerable amount of an inorganic filler. In addition, when the content of an inorganic filler to be added and the average particle diameter thereof were optimized, and when the surface roughness thereof was set to be in a predetermined range, the problems described above could be solved. Descriptions thereof as mentioned above will be described.

Furthermore, the tensile strength of the silicone rubber layer is preferably 50.0 MPa or less. When the tensile strength is in the range mentioned above, the topmost exterior layer of the silicone rubber layer is easily formed, and hence, it is more preferable in view of production thereof.

(A) Content of Inorganic Filler

The inventors of the present invention discovered that even when an inorganic filler was not added, or the content thereof was not more than 0.5 part by weight, or preferably, not more than 0.1 part by weight to 100 parts by weight of the silicone rubber, the tensile strength of the silicone rubber layer could be 1.0 MPa or more. When the tensile strength of the silicone rubber layer is 1.0 MPa or more, even in significantly long-term use, abrasion and breakage of the topmost exterior layer will not occur.

When an inorganic filler is not added, or the content thereof is not more than 0.5 part by weight, or preferably, not more than 0.1 part by weight to 100 parts by weight of the silicone rubber, abrasion at an edge portion of an oil control blade is less, increase in an amount of oil to be supplied can be suppressed over substantially long-term use.

When an inorganic filler is not contained in a solid silicone rubber layer formed at the topmost exterior of an oil coating roller, or the content thereof is small, such as not more than 0.5 part by weight to 100 parts by weight of the silicone rubber, no inorganic filler is present at all on the surface of the silicone rubber layer, or even when it is present, the amount thereof is small, whereby the topmost exterior layer has superior surface smoothness. Consequently, the releasing properties of the silicone rubber layer are improved, and toner offset resistance is improved, whereby an amount of toner offset accumulated on the surface of the oil coating roller can be reduced. As a result, the amount of offset toner transferred from a surface of a fixing roller is decreased, and amounts of offset toner fixed to individual units can be reduced, whereby image deficiencies, such as oil sagging, oil staining, and oil stripes, will not occur.

Accordingly, if it is not particularly necessary, no inorganic filler is preferably mixed with the silicone rubber layer; however, when properties other than mechanical strength, such as heat stability, must be improved, to 100 parts by weight of the silicone rubber, an inorganic filler is added in an amount of not more than 0.5 part by weight, preferably not more than 0.1 part by weight, more preferably not more than 0.09 part by weight, and even more preferably not more than 0.08 part by weight. In the ranges mentioned above, the releasing properties of the oil coating roller are not degraded.

When the content of the inorganic filler is in the ranges mentioned above, even if an inorganic filler is used which has an average diameter of 10 $\mu$m or more, heat stability, mechanical strength, and the like of the silicone rubber layer can be improved without increasing amounts of abrasion of the edge portion of the oil control blade.

(B) Average Diameter of Inorganic Filler

Through intensive research on the relationship between particle diameters of inorganic fillers and abrasion of edge portions of the blades, the inventors of the present invention discovered that, even if an inorganic filler was added, when the average diameter thereof was less than 10 $\mu$m, abrasion of the edge portion of the oil control blade could be reduced.

In addition, the inventors of the present invention discovered that, in the case in which an inorganic filler having an average particle diameter of less than 10 $\mu$m was used, when the content thereof was not more than 50 parts by weight, and more preferably, not more than 10 parts by weight to 100 parts by weight of the silicone rubber, an amount of oil supply was stable over long-term use without increasing the amount of abrasion of the edge portion of the oil control blade, whereby superior fixed images could be obtained.

The average particle diameter of the present invention is a diameter obtained by a method in which primary particles having larger particle diameter are selected from among particles measured by an electron microscope photograph, lengths in longitudinal directions of 10 particles are measured which are the primary particles having the largest particle diameter to the tenth primary particle in terms of larger particle diameter, and the diameters thus measured are averaged.

As the inorganic filler described above, there may be mentioned, for example, silica, iron dioxide, aluminum oxide, zinc oxide, powdered quartz, diatomaceous earth, calcium silicate, and talc.

(C) Surface Roughness of Silicone Rubber Layer

When an insufficient amount of oil is coated on the surface of the fixing roller, there will be problems in that an amount of offset toner may be increased, and a life of the fixing roller may be decreased in some cases. In contrast, when an excess amount of the oil is coated on the surface of the fixing roller, there will be problems in that, for example, color reproducibility of fixed images may be degraded, oil staining on recording sheets may occur, and tactile sensation of an OHP sheet may be degraded in some cases. Consequently, the amount of oil coated on the surface of the fixing roller must always be controlled in an appropriate range.

The inventors of the present invention discovered that a coating amount of the oil was determined by an amount of the oil passing through a minute gap formed by a roughened form on the surface of the oil coating roller and the oil control blade which was brought into contact therewith, and that the coating amount of the oil could thereby be optionally determined by controlling the roughened form on the surface of the oil coating roller, i.e., the surface roughness Rz of the oil coating roller. In addition, it was also discovered that, when the surface roughness Rz thereof was set to be in the range of 0.5 to 20 $\mu$m, an amount of oil coated on the surface of the fixing roller could be appropriately controlled, and hence, superior fixed images could be provided.

That is, when the surface roughness Rz of the oil coating roller is 0.5 $\mu$m or less, the minute gap is too small which is formed by the roughened form on the surface of the oil coating roller and the oil control blade which is brought into contact therewith, and as a result, the coating amount of the oil may be insufficient in some cases. In contrast, when the surface roughness Rz of the oil coating roller is 20 $\mu$m or more, the minute gap is too large which is formed by the roughened form on the surface of the oil coating roller and the oil control blade which is brought into contact therewith, and as a result, a coating amount of the oil may exceed the appropriate range in some cases. Accordingly, in both cases, superior fixed images may not be obtained in some cases.

In addition, by using the means for controlling the coating amount of the oil described above, the initial amount of the coating oil can be controlled more easily than that which is conventionally controlled. The reason for this is that, in the means for controlling the amount of the coating oil of the present invention, since it is sufficient that only the surface roughness of the oil coating roller is controlled, and improvement of conventional apparatuses and difficult control thereof are not necessary, a desired initial coating amount of the oil can be realized at a lower cost by using a simple method.

The surface roughness described in the present invention is an average roughness Rz of ten points measured in accordance with JIS (Japanese Industrial Standard) B0601.

(D) Silicone Rubber

In the present invention, in order to form a silicone rubber layer having a superior tensile strength even though the content and the average particle diameter of an inorganic filler are in the ranges as described above and to realize a predetermined surface roughness, a silicone rubber having the following composition is preferably used.

That is, the silicone rubber contained in the silicone rubber layer is preferably a cross-linkable addition type silicone rubber, a cross-linkable organic peroxide type silicone rubber, or a cross-linkable condensation type silicone rubber.

The silicone rubber contained in the silicone rubber layer is preferably a polymer compound formed by cross-linking a mixture comprising a non-linear polyorganosiloxane (a1) and a linear polyorganosiloxane (b1). In addition, the cross-linking reaction is preferably an organic peroxide type reaction.

The silicone rubber contained in the silicone rubber layer is preferably a polymer compound formed by cross-linking a first functional group and a second functional group in a mixture comprising a non-linear polyorganosiloxane (a2) having the first functional groups directly bonded to at least two silicon atoms, a linear polyorganosiloxane (b2) having the first functional groups directly bonded to silicon atoms at the two ends of the polyorganosiloxane, and a polyorganosiloxane (c2) having the second functional groups directly bonded to at least two silicon atoms. In addition, the cross-linking reaction is preferably an addition type reaction, an organic peroxide type reaction, or a condensation type reaction.

The cross-linkable addition type silicone rubber is a rubber formed by cross-linking polyorganosiloxanes by an addition type reaction. A cross-linkable addition type silicone rubber can be obtained by proceeding an addition type reaction between the first functional groups having unsaturated bonds, such as a vinyl functional group, and the second functional groups, such as hydrogen, in the presence of a small amount of a platinum-based catalyst or by heating.

The cross-linkable organic peroxide type silicone rubber is a rubber formed by cross-linking polyorganosiloxanes in the presence of an organic peroxide. The organic peroxides may be mentioned acyl peroxides such as benzoyl peroxide, alkyl peroxides such as di(t-butyl) peroxide, and the like.

The cross-likable condensation type silicone rubber is a rubber formed by cross-linking polyorganosiloxanes by a condensation type reaction which proceeds between appropriate functional groups thereof. As a condensation type reaction, there may be mentioned, for example, a deacetic acid, a dealcohol, a deoxime, a deamination, a deamide, a deaminoxy, a deacetone, a dehydrogenetaion, and a dehydration reaction.

The weight-average molecular weight of the polyorganosiloxanes (a1) and (a2) are preferably 80 to 2,000, and more preferably, 100 to 1,000. By using the polyorganosiloxanes (a1) and (a2), an obtained silicone rubber has a highly cross-linked structure, and the tensile strength thereof is thereby further improved. In addition, when the weight-average molecular weights thereof are in the ranges mentioned above, the polyorganosiloxanes (a1) and (a2) are liquid and are thereby easy to handle in manufacturing process. In addition, the individual contents of the polyorganosiloxanes (a1) and (a2) in the silicone rubbers on a part by weight basis are preferably 60% or more, more preferably 65% or more, even more preferable 90% or less, and even further preferable 85% or less.

The weight-average molecular weights of the polyorganosiloxanes (b1) and (b2) are preferably 800 to 200,000, and more preferably, 1000 to 100,000. When the weight-average molecular weights of the polyorganosiloxanes (b1) and (b2) are in the ranges mentioned above, the polyorganosiloxanes (b1) and (b2) are super high molecular weight polymers, and hence, the tensile strength of the silicone rubber obtained therefrom is even superior. Furthermore, the individual contents of the polyorganosiloxanes (b1) and (b2) in the silicone rubbers on a part by weight basis are preferably 10% or more, more preferably 15% or more, even more preferable 40% or less, and even further preferable 35% or less.

The weight-average molecular weight of the polyorganosiloxane (c2) is preferably 80 to 2,000, and more preferably, 100 to 1,000. In particular, when the second functional group is hydrogen, the polyorganosiloxane (c2) serves as a cross-linking component. In addition, when the weight-average molecular weight thereof is in the range mentioned above, the polyorganosiloxane (c2) is liquid and is thereby easy to handle in the manufacturing process. In addition, the polyorganosiloxane (c2) may be mixed with the polyorganosiloxanes (a2) and (b2) in a manner described below. The number of the second functional groups is preferably 1.0 times or more the total number of the first functional groups contained in the polyorganosiloxanes (a2) and (b2), more preferably 1.2 times or more, even more preferable 2.5 times or less, and even further preferable 2.0 times or less.

When necessary, 0.1 to 90 parts by weight of a polyorganosiloxane (c1) may be preferably added to 100 parts by weight of the mixture of the polyorganosiloxanes (a1) and (b1). The weight-average molecular weight of the polyorganosiloxane (c1) is preferably 80 to 2,000, and more preferably 100 to 1000. In this case, the polyorganosiloxane (c1) functions as a cross-linking agent, whereby superior cross-linking density can be maintained.

By using the silicone rubber described above, various properties of an oil coating roller, which is to be obtained, are even improved.

In this connection, when necessary, silicon atoms of the polyorganosiloxanes of the present invention may have substituents bonded thereto. As substituents, there may be mentioned, for example, an alkyl group represented by a methyl group for imparting mechanical properties and chemical stability, a phenyl group for imparting heat resistance and low temperature resistance, and a halogen substituted alkyl group represented by a fluoropropyl group for imparting solvent resistance.

As examples of the silicone rubber described above, there may be mentioned methyl silicone rubber, dimethyl silicone rubber, fluoro-silicone rubber, vinyl methyl silicone rubber, phenyl silicone rubber, and the like. Addition type methyl phenyl polysiloxane is a polysiloxane obtained from a siloxane compound having an additive type functional group, such as a vinyl functional group, in addition to a methyl group and a phenyl group, and by cross-linking the polyorganosiloxane described above, cross-linkable addition type silicone rubber can be obtained. Cross-linking agents are not specifically limited so long as the polyorganosiloxanes described above are cross-linked, and optional agents can be used. When a silicone rubber is a mirable type silicone rubber, organic peroxides are used. As organic peroxides mentioned above, there may be mentioned benzoyl peroxide, bis-2,4-dichlorocyclobenzoyl peroxide, di-t-butyl peroxide, dicumyl peroxide, and the like, these may be used alone or in combination. In general, the cross-linking agent mentioned above in an amount of 0.01 to 5 parts by weight, and preferably 0.1 to 3 parts by weight is added to 100 parts by weight of the polyorganosiloxane described above.

The silicone rubber layer formed at the topmost exterior layer of the oil coating roller is, as shown in FIG. 1, a solid silicone rubber layer 2, which is not a foamed silicone rubber, formed on the exterior layer of a plug 1. The tensile strength thereof is measured in accordance with JIS K 6301 (physical evaluation method of vulcanized rubber).

Hereinafter, preferred embodiments of devices provided with the oil coating rollers of the present invention.

That is, by using the oil coating roller described above for coating a silicone oil on the surface of the fixing roller and the oil control blade for controlling the silicone oil supplied to the oil coating roller to be constant, an oil coating device having superior properties can be obtained.

The edge portion of the oil control blade, which is brought into contact with the oil coating roller, is preferably composed of an elastic material.

In particular, as an elastic material, a silicone rubber is preferable. The reason for this is that powdered paper, toner, and the like are difficult to adhere to a silicone rubber, and hence, an oil control blade composed of a silicone rubber is superior in staining resistance.

In addition, the edge portion may be formed of a fluorocarbon elastomer in some cases. The reason for this is that a fluorocarbon elastomer is superior in heat stability, mechanical properties, and the like, and hence, distortion and degradation of the strength thereof will not occur over long periods of time at a high temperature.

In order to improve heat stability, mechanical strength, and the like, fillers, processing aids, plasticizers, coloring agents, and the like may be added to the elastomer in some cases. In particular, in order to improve abrasion resistance, a fluorocarbon resin may be added in some cases.

As a fluorocarbon elastomer used as an elastic material for the edge portion of the oil control blade, there may be mentioned a fluorocarbon elastomer selected from the group of a vinylidene fluoride-based elastomer, tetrafluoroethylene-propylene elastomer, tetrafluoroethylene-perfluoromethylvinyl ether elastomer, a phosphazen-based fluorocarbon elastomer, a fluoropolyether elastomer, and the like. In addition, when necessary, a filler, such as carbon black, graphite, silica, clay, diatomaceous earth, talc, calcium carbonate, calcium fluoride, barium sulfate, and the like, may be added to the fluorocarbon elastomer mentioned above. The content of the filler mentioned above is generally not more than 100 parts by weight to 100 parts by weight of the fluorocarbon elastomer.

In addition, an oil control blade is more preferable used in which a silicone rubber is formed on the edge face of a fluorocarbon elastomer base. In the oil control blade mentioned above, superior heat stability can be realized due to the fluorocarbon elastomer, and at the same time, accumulation of materials, such as offset toner and powdered paper, adhered to the edge portion of the blade can be reduced compared to that in the case of an oil control blade merely composed of a fluorocarbon elastomer.

The oil coating device as described above is preferably provided in the fixing apparatus. The oil coating device described above can be used, for example, in the fixing apparatus comprising a pair of rotating units which rotate while pressing each other and form a nip portion at which a transfer medium is pressed and conveyed, at least one of the pair of rotating units provided with a means for coating a releasing agent, in which a developer image is fixed on the transfer medium as a permanent image by heating and pressing the developer image formed on the transfer medium at the nip portion.

In the fixing apparatus described above, since an appropriate initial coating amount of the oil is supplied to the surface of the fixing roller, and increase in the coating amount thereof is small as operation time passes, stable fixed images can be obtained over long periods of time.

The oil coating roller can be produced by a known method, such as extrusion and molding (compression molding, transfer molding, and potting), and in order to obtain a desired outside diameter of roller, the surface thereof may be polished in some cases. In particular, when the roller is produced by extrusion, compression molding, or transfer molding, a polishing treatment of the surface of the roller need to be performed in order to obtain a desired outside diameter thereof. In this step, the surface of the roller is polished so as to have desired roughness. As a method for forming desired roughness on the surface of the roller, in addition to a polishing treatment mentioned above, a method for roughening the surface of the roller by blasting can also be used. A method for forming a roller by potting using a cylindrical mold is more preferable due to small variation between rollers in production, since a roughened surface of the roller can be formed by transferring a desired roughened surface formed inside the mold beforehand.

Before coating a primer on the plug surface of the roller in order to improve adhesive force, it is preferable that the surface thereof be degreased and washed. In addition, it is preferable that blasting, such as chemical blasting or sand blasting, be performed.

As a particular method for forming a roller, for example, a plug, which is processed by degreasing, blasting, and primer coating, is disposed inside a mold for compression molding or transfer molding, in which a predetermined shape is formed beforehand, a rubber compound prepared using a mixing roll beforehand is filled in the mold, and the rubber compound is vulcanized by heating under pressure so as to form a silicone rubber, whereby the solid silicone rubber is obtained. Subsequently, a method is used in which a desired outside diameter of the roll is formed by polishing the surface thereof using a cylindrical grinder or the like, and the surface of the roller is simultaneously processed so as to have a desired roughness.

In the other method, a plug is fixed at a predetermined position in a cylindrical mold in which a desired shape and desired roughness were formed beforehand, caps are mounted at the upper part and the lower part of the mold, an addition type silicone rubber compound is poured from a gap between the mold and the lower cap into the mold so as to fill a void therein, and the silicone rubber compound is subsequently cured by heating. The roughened shape formed in the mold is transferred to the surface of the roller thus formed, and hence, an oil coating roller having a desired surface roughness can be obtained. The method described above is preferable since variation in production and variation between rollers are small.

In both methods described above, after the silicone rubber is removed from the mold, the silicone rubber is preferably heated to approximately 200° C. for approximately 4 hours for secondary vulcanization.

The thickness of the silicone rubber at the topmost exterior layer is not specifically limited and is generally set to be approximately 1 to 10 mm. The dimensions of the oil coating roller are, for example, the outside diameter thereof is 30 mm, and the longitudinal length thereof is 310 mm. The oil coating roller thus described can be obtained by forming a silicone rubber 2 mm thick on a metal plug 26 mm in diameter with a primer layer provided therebetween.

Tensile strength can be measured using a tensile tester, such as, Tensilone EM-500 manufactured by Toyo Boldwin Co. In addition, surface roughness Rz can be measured using, for example, Surfcom 480A manufactured by Tokyo Seimitsu Co., Ltd.

Figure 2:
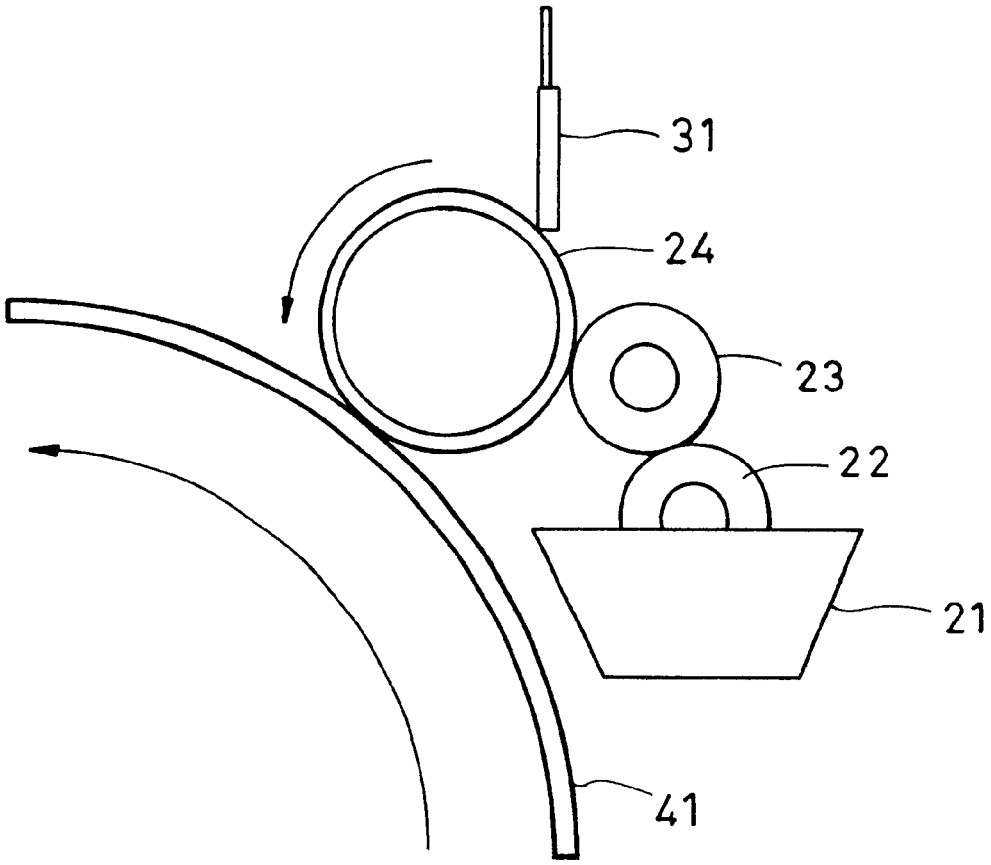
FIG. 2 is a schematic cross-sectional view of an oil coating device of the present invention.

An example of the oil coating device of the present invention is shown in FIG. 2. A coating oil received in an oil pan 21 is supplied to an oil coating roller 24 using a first scooping roller 22 and a second scooping roller 23, an amount of a fixing oil on the surface of the oil coating roller 24 is controlled by an oil control blade 31 urged toward the oil coating roller 24 by a spring, and the oil is then coated on a fixing roller 41.

Figure 3:
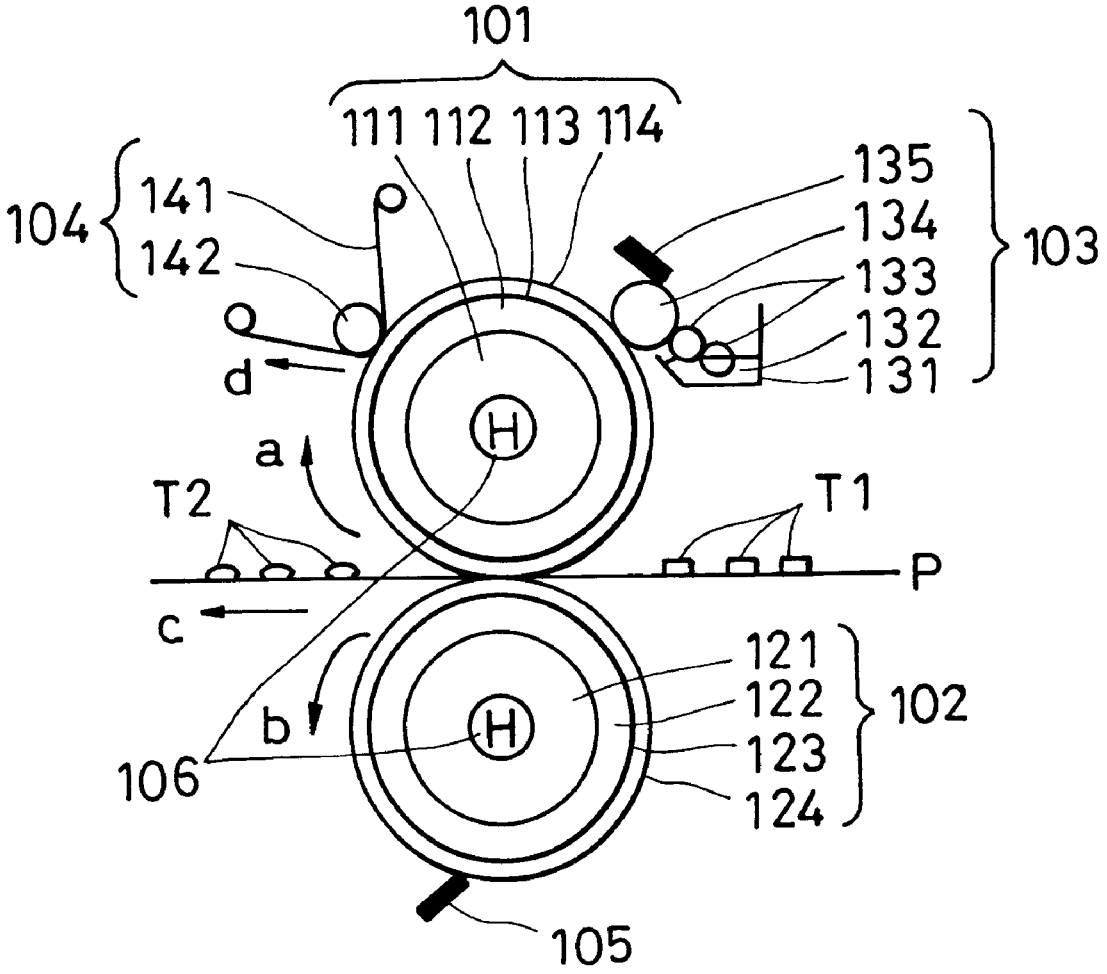
FIG. 3 is a schematic cross-sectional view of a fixing apparatus of the present invention.

An example of the fixing apparatus of the present invention is shown in FIG. 3. The fixing apparatus comprises a pair of rotating rollers composed of a fixing roller 101 and a pressure roller 102 urged toward the roller 101, in which heaters 106 used as heat sources are provided in the individual rollers. The fixing roller 101 and the pressure roller 102, which have outside diameters of 60 mm, form a nip approximately 7 mm width by pressing each other at a predetermined pressure. At the fixing roller 101 side, there are provided an oil coating device 103 for coating a silicone oil used as a releasing agent and a cleaning webbing unit 104 for removing materials, such as offset toner and powdered paper, adhered on the surface of the fixing roller 101. A recording medium P, which has a toner image having a plurality of colors at the fixing roller side, is supplied between the fixing roller 101 and the pressure roller 102, and the two rollers described above heat and pressurize the toner image while the recording medium P passes therebetween, whereby the toner image is fixed on a transfer medium by fusing the toner and mixing the colors thereof.

The fixing roller 101 is composed of a plug 111 as a base, an elastic layer 112 provided thereon composed of an HTV type silicone rubber approximately 2 mm thick, an oil barrier layer 113 provided thereon composed of a fluorocarbon elastomer approximately 30 μm thick, and a surface layer 114 approximately 250 μm thick as an topmost exterior layer composed of an LTV type silicone rubber having high releasing properties. The pressure roller 102 is composed of, as is the case with the fixing roller 101, a plug 121 as a base, an elastic layer 122 provided thereon composed of an HTV type silicone rubber approximately 2 mm thick, an oil barrier layer 123 provided thereon composed of a fluorocarbon elastomer approximately 30 μm thick, and a surface layer 124 approximately 250 μm thick as an topmost exterior layer composed of an LTV type silicone rubber having high releasing properties.

The oil coating device 103, which supplies a releasing oil 132 as a releasing agent on the surface of the fixing roller 101, is provided at the fixing roller 101 side. The oil coating device 103 is composed of an oil pan 131 for receiving an oil, an oil scooping roller 133 for scooping the oil in the oil pan 131 and for transferring it to an oil coating roller 134, the oil coating roller 134 for coating the silicone oil on the surface of the fixing roller 101, and an oil control blade 135 in contact with the surface of the oil coating roller 134 so as to control an amount of the oil thereon. As the releasing oil 132, dimethyl silicone oil (KF-96SS, manufactured by Shin-Etsu Chemical Co., Ltd.) having dynamic viscosity of 300 centistokes at 25° C. and the like can be used.

In addition, a cleaning webbing unit 104 is provided at the fixing roller 101 side which removes materials, such as offset toner and powered paper, adhered on the surface of the fixing roller 101. The cleaning webbing unit 104 is composed of a pressing roller 142 and a cleaning webbing 141, in which the pressing roller 142 presses the cleaning webbing 141 so as to contact with the surface of the fixing roller 101.

EXAMPLES

Hereinafter, the present invention will be described in detail with reference to the examples; however, the present invention is not limited thereto.

In Examples 1 to 3 and Comparative Examples 1 to 3, endurance tests were performed by mounting an oil coating roller in a fixing apparatus of a color laser copying machine CLC 700 (manufactured by Canon Kabushiki Kaisha). As an oil control blade brought into contact with the oil coating roller, an oil control blade, which is a standard unit equipped with the color laser copying machine CLC 700, was used, and the edge portion of the oil control blade was formed of a fluorocarbon elastomer.

Example 1

After washing a plug 1 having an outside diameter of 26 mm shown in FIG. 1, a primer (manufactured by Shin-Etsu Chemical Co., Ltd., Primer No. 101) for a cross-linkable addition type silicone rubber was coated on the surface of the plug 1 and was then baked at 200° C. for 1 hour in a hot-air oven, thereby performing a primer treatment. The plug 1 was concentrically inserted in a cylindrical mold having an inside diameter of 30 mm and was fixed by caps provided in the cylindrical mold so as to directly come into contact with the side surfaces of the upper portion and the lower portion of the plug 1. The longitudinal direction of the mold was disposed in the vertical direction, a cross-linkable addition type silicone rubber compound was poured through a gap formed between the lower cap and the cylindrical mold, whereby a void formed between the mold and a spongy layer was filled. The unit thus formed was heated to 150° C. for 1 hour in a hot air environment, so that the silicone compound was vulcanized.

After heating, the roller thus obtained was removed from the cylindrical mold and was then heated to 200° C. for 4 hours so as to perform secondary vulcanization, thereby yielding an oil coating roller of this example. The thickness of the silicone rubber layer 2 of the oil coating roller thus formed was 2 mm, and the tensile strength thereof was 4.0 MPa.

A cross-linkable addition type silicone rubber compound of this example was prepared as described below. That is, a mixture was formed of 70 parts by weight of a block copolymer having a viscosity of approximately 30 Pa·s at 25° C. composed of polyorganosiloxane (a) formed of linear polysiloxane segments each having approximately 300 bifunctional dimethyl siloxane units in series and branched polysiloxane segments, each having one vinyl group, bonded to the two ends of the linear polysiloxane segment and 30 parts by weight of a polyorganosiloxane (b) having a viscosity of approximately 10,000 Pa·s at 25° C. composed of a linear polydimethylsiloxane having vinyl groups at the two ends thereof. Next, a polyorganosiloxane (c) having at least two hydrogen atoms bonded to silicone atoms was added as a cross-linking agent to the mixture of the polyorganosiloxanes (a) and (b) so that the number of hydrogen atoms thereof was 1.3 times the total number of vinyl functional groups contained in the mixture described above. Subsequently, a platinum-based catalyst was added to the mixture thus formed, thereby forming a cross-linkable addition type silicone rubber compound.

The oil coating roller obtained was mounted in the oil coating device of the fixing apparatus of the color laser copying machine CLC 700, and endurance test was performed. In the endurance test, a coating amount of oil on each copy sheet (A-4 size) was measured when a predetermined number of sheets was fed for the endurance test, and at the same time, tactile sensation of a surface of an OHP sheet was determined. In addition, image quality was confirmed, and an accumulated amount of offset toner in the vicinity of the oil coating device was observed after the endurance test was completed. The results are shown in Table 1.

As shown in Table 1, in the oil coating roller of this example, even after a long-term endurance test using 50,000 sheets, increase in coating amount of oil was not observed at all, and hence, the OHP sheet was not degraded by a gummy feeling. In addition, the image quality was not degraded, and the accumulated amount of offset toner in the vicinity of the oil coating device was small. That is, since the oil coating roller of the present invention has superior releasing properties and will not abrade the edge portion of the oil control blade, it was confirmed that the oil coating device of the present invention has significantly superior long-term stability.

Example 2

An oil coating roller of this example was formed in a manner equivalent to that in Example 1 except that powdered quartz in an amount of 0.05 part by weight was added to 100 parts by weight of the cross-linkable addition type silicone rubber used in Example 1. The tensile strength of the silicone rubber layer having the silica therein was 4.2 MPa, and the thickness of the silicone rubber layer of the oil coating roller thus formed was 2.0 mm.

Example 3

A mixture was formed of 80 parts by weight of a block copolymer having a viscosity of approximately 30 Pa·s at 25° C. composed of a polyorganosiloxane (a) formed of linear polysiloxane segments each having approximately 300 bifunctional dimethyl siloxane units in series and branched polysiloxane segments, each having one vinyl group, bonded to the two ends of the linear polysiloxane segment and 20 parts by weight of a polyorganosiloxane (b) having a viscosity of approximately 10,000 Pa·s at 25° C. composed of a linear polydimethylsiloxane having vinyl groups at the two ends thereof. Next, a polyorganosiloxane (c) having at least two hydrogen atoms bonded to silicone atoms was added as a cross-linking agent to the mixture of the polyorganosiloxanes (a) and (b) so that the number of hydrogen atoms thereof was 1.3 times the total number of vinyl functional groups contained in the mixture described above. A platinum-based catalyst was added to the mixture thus formed, whereby a cross-linkable addition type silicone rubber compound was prepared.

By using the cross-linkable addition type silicone rubber compound thus prepared, an oil coating roller was formed, in which no inorganic filler was contained in the topmost exterior layer as was the case with Example 1. The tensile strength of the silicone rubber layer was 4.2 MPa, and the thickness of the silicone rubber layer of the oil coating roller thus formed was 2.0 mm.

Examples 2 and 3

The oil coating rollers thus obtained were mounted in the oil coating device in the fixing apparatus of the color laser copying machine CLC 700, and endurance test was performed. In the endurance test, an amount of oil coated on each copying sheet (A-4 size) was measured when a predetermined number of sheets was fed for the endurance test, and at the same time, tactile sensation of the OHP sheet was determined. In addition, image qualities were confirmed, and accumulated amounts of offset toner in the vicinity of the oil coating device were observed after the endurance test was completed. The results are shown in Table 1.

As shown in Table 1, in the oil coating rollers obtained in the examples, the increase of the coating amount of the oil was small even in the long-term endurance test using 50,000 sheets, and there was no problem in practical use. In addition, gummy feeling of the OHP sheet was significantly small sufficient in practical use. Furthermore, degradation of image quality was not confirmed, and the accumulated amount of the offset toner in the vicinity of the oil coating device was also small. That is, since the oil coating roller of the present invention had superior releasing properties and would not abrade the edge portion of the oil control blade, it was confirmed that the oil coating device of the present invention had significantly superior long-term stability.

TABLE 1

| | Example 1 | | | | Example 2 | | | | Example 3 | | | |
|---|---|---|---|---|---|---|---|---|---|---|---|---|
| Endurance Test (Sheets) | Coating Oil Amount (mg) | Tactile Sensation of OHP | Accumulated Toner Amount | Image Quality | Coating Oil Amount (mg) | Tactile Sensation of OHP | Accumulated Toner Amount | Image Quality | Coating Oil Amount (mg) | Tactile Sensation of OHP | Accumulated Toner Amount | Image Quality |
| 1,000 | 10 | Good | Small | Good | 10 | Good | Small | Good | 10 | Good | Small | Good |
| 3,000 | 10 | Good | Small | Good | 10 | Good | Small | Good | 10 | Good | Small | Good |
| 5,000 | 10 | Good | Small | Good | 10 | Good | Small | Good | 10 | Good | Small | Good |
| 10,000 | 10 | Good | Small | Good | 10 | Good | Small | Good | 10 | Good | Small | Good |
| 30,000 | 10 | Good | Small | Good | 20 | Good | Small | Good | 10 | Good | Small | Good |
| 50,000 | 10 | Good | Small | Good | 20 | Good | Small | Good | 10 | Good | Small | Good |

Comparative Example 1

An oil coating roller was formed in a manner equivalent to that in Example 1 except that powdered quartz in an amount of 0.05 part by weight was added to 100 parts by weight of the cross-linkable addition type silicone rubber used in Example 1. The thickness of the silicone rubber layer of the oil coating roller thus formed was 2.0 mm, and the tensile strength thereof was 4.5 MPa. Endurance test was performed concurrently with that in Example 1.

As shown in Table 2, when the oil coating roller obtained in Comparative Example 1 was used, the coating amount of oil was rapidly increased at 10,000 sheets, which was an early stage of the endurance test, and concomitant with the increase of the oil mentioned above, the OHP sheet was degraded by a gummy feeling, resulting in degradation of the image quality and the increase in the accumulated offset toner.

Comparative Example 2

A mixture was formed of 50 parts by weight of a block copolymer having a viscosity of approximately 30 Pa·s at 25° C. composed of linear polysiloxane segments each having approximately 300 bifunctional dimethyl siloxane units in series and branched polysiloxane segments, each having one vinyl group, bonded to the two ends of the linear polysiloxane segment, and 50 parts by weight of a linear polydimethylsiloxane provided with no vinyl group therein having a viscosity of approximately 10,000 Pa·s at 25° C. Next, a polyorganosiloxane having at least two hydrogen atoms bonded to silicone atoms was added as a cross-linking agent to the mixture described above so that the number of hydrogen atoms thereof was 1.3 times the total number of vinyl functional groups contained in the block copolymer described above. A platinum-based catalyst was added to the mixture thus formed, whereby a cross-linkable addition type silicone rubber compound was prepared.

By using the cross-linkable addition type silicone rubber compound thus prepared, an oil coating roller was formed, in which no inorganic filler was not contained in the topmost exterior layer as was the case with Example 1. The tensile strength of the silicone rubber layer was 0.7 MPa, and the thickness of the silicone rubber layer of the oil coating roller thus formed was 2.0 mm. Endurance test was performed in a manner equivalent to that in Example 1. The results are shown in Table 2.

When the oil coating roller obtained in Comparative Example 2 was used, the solid silicone rubber layer at the topmost exterior layer of the oil coating roller was abraded at 5,000 sheets, which was an early stage of the endurance test, and a number of minute grooves were generated in circumferential directions of the roller. As a result, irregularity of oil coating was generated on the images, and hence, the oil coating roller was insufficient in practical use.

TABLE 2

| | Comparative Example 1 | | | | Comparative Example 2 | | | |
|---|---|---|---|---|---|---|---|---|
| Endurance Test (Sheets) | Coating Oil Amount (mg) | Tactile Sensation of OHP | Accumulated Toner Amount | Image Quality | Coating Oil Amount (mg) | Tactile Sensation oh OHP | Accumulated Toner Amount | Image Quality |
| 1,000 | 10 | Good | Small | Good | 10 | Good | Small | Good |
| 3,000 | 10 | Good | Small | Good | 10 | Good | Small | Good |
| 5,000 | 10 | Good | Small | Good | 50 | No Good | Large | No Good |
| 10,000 | 50 | No Good | Large | No Good | 50 | No Good | Large | No Good |
| 30,000 | 50 | No Good | Large | No Good | 50 | No Good | Large | No Good |
| 50,000 | 50 | No Good | Large | No Good | 50 | No Good | Large | No Good |

Next, in Examples 4 to 6 and Comparative Examples 3 to 5, an oil control blade was used which was formed of a fluorocarbon elastomer provided with a silicone rubber at the edge face thereof.

A fluorocarbon elastic polymer (Daiel G-723, manufactured by Daikin Industries, Ltd) was vulcanized and molded, thereby forming a fluorocarbon elastomer blade. A part of the edge face, 1.5 mm distant from the top thereof, of the fluorocarbon elastomer blade thus formed was cut away, and a primer treatment was performed on the cut surface, and a silicone rubber layer 1.5 mm thick was then formed on the cut surface by molding. As molding, the blade and a silicone rubber compound were charged beforehand in a mold which can be disassembled into a plurality of units, compression molding was performed in which thermosetting molding was carried out using a hop plate pressing machine by heating and compressing. The curing condition was set to be 130° C. for 10 minutes. Subsequently, the oil control blade, which was provided with the silicone rubber formed on the edge face composed of the fluorocarbon elastomer, was removed from the mold and was then heated to 200° C. for 4 hours in a hot-air circulating oven for secondary vulcanization. The silicone rubber layer formed on the edge face of the fluorocarbon elastomer was cut using a sharp cutter so as to have a thickness of 1.0 mm and so as to be in parallel with the edge face of the fluorocarbon elastomer, whereby an oil control blade was obtained which will be used as described below.

In Examples and Comparative Examples described below, endurance tests were performed by mounting the oil coating roller and the oil control blade of the present invention in the fixing apparatus of the color laser copying machine CLC 700 (manufactured by Canon Kabushiki Kaisha), in which full-color images were fixed on 50,000 sheets which were continuously fed. In the endurance test, a coating amount of oil on each copy sheet (A-4 size) was measured when a predetermined number of sheets was fed for the endurance test, and at the same time, tactile sensation of a surface of an OHP sheet was determined. In addition, image quality was confirmed, and an accumulated amount of offset toner in the vicinity of the oil coating device was observed after the endurance test was completed.

Example 4

After washing a plug having an outside diameter of 26 mm, a primer (manufactured by Shin-Etsu Chemical Co., Ltd., Primer No. 101) for a cross-linkable addition type silicone rubber was coated on the surface of the plug and was then baked at 200° C. for 1 hour in a hot-air oven, thereby performing a primer treatment. The plug thus treated was concentrically inserted in a cylindrical mold having an inside diameter of 30 mm and was fixed by caps provided in the cylindrical mold so as to directly come into contact with the side surfaces of the upper portion and the lower portion of the plug. The longitudinal direction of the mold was disposed in the vertical direction, a cross-linkable addition type silicone rubber compound was poured through a gap formed between the lower cap and the cylindrical mold, whereby a void between the mold and the plug was filled. The unit thus formed was heated to 150° C. for 1 hour in a hot air environment, so that the silicone compound was vulcanized.

After heating, the roller thus formed was removed from the cylindrical mold and was then heated to 200° C. for 4 hours so as to perform secondary vulcanization, thereby yielding an oil coating roller of this example. The thickness of the silicone rubber layer of the oil coating roller thus formed was 1.4 mm, and the tensile strength thereof was 4.2 MPa. In addition, the surface roughness of the roller was 3.5 $\mu$m.

A cross-linkable addition type silicone rubber compound of this example was prepared as described below. That is, a mixture was formed of 70 parts by weight of a block copolymer having a viscosity of approximately 30 Pa·s at 25° C. composed of a polyorganosiloxane (a) formed of linear polysiloxane segments each having approximately 300 bifunctional dimethyl siloxane units in series and branched polysiloxane segments, each having one vinyl group, bonded to the two ends of the linear polysiloxane segment and 30 parts by weight of a polyorganosiloxane (b) having a viscosity of approximately 10,000 Pa·s at 25° C. composed of a linear polydimethylsiloxane having vinyl groups at the two ends thereof. Next, a polyorganosiloxane (c) having at least two hydrogen atoms bonded to silicone atoms was added as a cross-linking agent to the mixture of the polyorganosiloxanes (a) and (b) so that the number of hydrogen atoms thereof was 1.3 times the total number of vinyl groups contained in the mixture described above. Furthermore, a platinum-based catalyst and 0.05 part by weight of powdered quartz having an average particle diameter of 15 $\mu$m was added to the mixture described above, thereby preparing the cross-linkable addition type silicone rubber compound.

The oil coating roller obtained was mounted in the oil coating device of the color laser copying machine CLC 700, and endurance test was performed. The results are shown in Table 3.

As shown in Table 3, in this example, the initial coating amount of oil was 10 mg (per A-4 size sheet), and image deficiencies, such as oil stripes and oil staining on images, were not generated. Even in the long-term endurance test using 50,000 sheets, abrasions of the edge portion of the oil control blade and the surface of the oil coating roller were not observed, and hence, increase in coating amount of the oil and degradation of tactile sensation of the OHP sheet did not occur. In addition, in the oil coating roller of the present invention, the amounts of offset toner, powdered paper, and the like, which were transferred on the oil coating roller, were small.

An oil coating roller was formed in a manner equivalent to that in Example 4 except that an inorganic filer was not contained in the cross-linkable addition type silicone rubber used in Example 4. The tensile strength of the silicone rubber layer was 4.1 MPa, and the surface roughness thereof was 3.4 $\mu$m.

The oil coating roller thus formed was mounted in the oil coating device of the color laser copying machine CLC 700, and endurance test was performed. The results are shown in Table 3.

As shown in Table 3, in this example, the initial coating amount of oil was 10 mg (per A-4 size sheet), and image deficiencies, such as oil stripes and oil staining on images, were not generated. Even in the long-term endurance test using 50,000 sheets, abrasions of the edge portion of the oil control blade and the surface of the oil coating roller were not observed, and hence, increase in coating amount of the oil and degradation of tactile sensation of the OHP sheet did not occur. In addition, in the oil coating roller of the present invention, the amounts of offset toner, powdered paper, and the like, which were transferred on the oil coating roller, were small.

Example 6

An oil coating roller was formed in a manner equivalent to that in Example 4 except that the surface of the roller was polished so that the surface roughness thereof was 10 $\mu$m.

The oil coating roller thus formed was mounted in the oil coating device of the color laser copying machine CLC 700, and endurance test was performed. The results are shown in Table 3.

As shown in Table 3, in this example, the initial coating amount of oil was 25 mg (per A-4 size sheet), and image deficiencies, such as oil stripes and oil staining on images, were not generated. Even in the long-term endurance test using 50,000 sheets, abrasions of the edge portion of the oil control blade and the surface of the oil coating roller were not observed, and hence, increase in coating amount of the oil and degradation of tactile sensation of the OHP sheet did not occur. In addition, in the oil coating roller of the present invention, the amounts of offset toner, powdered paper, and the like, which were transferred on the oil coating roller, were small.

TABLE 3

| Endurance Test (Sheets) | Coating Oil Amount (mg) | Tactile Sensation of OFP | Accumulated amount of Toner | Image Quality |
|---|---|---|---|---|
| | | Example 4 | | |
| Initial | 10 | Good | Small | Good |
| 1,000 | 10 | Good | Small | Good |
| 3,000 | 10 | Good | Small | Good |
| 5,000 | 10 | Good | Small | Good |
| 10,000 | 10 | Good | Small | Good |
| 30,000 | 10 | Good | Small | Good |
| 50,000 | 10 | Good | Small | Good |
| **Endurance Test (Sheets)** | **Coating Oil Amount (mg)** | **Tactile Sensation of OHP** | **Accumulated amount of Toner** | **Image Quality** |
| | | Example 5 | | |
| Initial | 10 | Good | Small | Good |
| 1,000 | 10 | Good | Small | Good |
| 3,000 | 10 | Good | Small | Good |
| 5,000 | 10 | Good | Small | Good |
| 10,000 | 10 | Good | Small | Good |
| 30,000 | 10 | Good | Small | Good |
| 50,000 | 10 | Good | Small | Good |

TABLE 3-continued

| | | | | |
|---|---|---|---|---|
| | | Example 6 | | |
| Initial | 25 | Good | Small | Good |
| 1,000 | 25 | Good | Small | Good |
| 3,000 | 25 | Good | Small | Good |
| 5,000 | 25 | Good | Small | Good |
| 10,000 | 25 | Good | Small | Good |
| 30,000 | 25 | Good | Small | Good |
| 50,000 | 25 | Good | Small | Good |

Comparative Example 3

An oil coating roller was formed in a manner equivalent to that in Example 4 except that 3.0 parts by weight of powdered quartz having an average diameter of 15 μm was added to 100 parts by weight of the cross-linkable addition type silicone rubber used in Example 4. The tensile strength of the silicone rubber layer was 4.5 MPa, and the surface roughness thereof was 3.6 μm.

The oil coating roller thus formed was mounted in the oil coating device of the color laser copying machine CLC 700, and endurance test was performed. The results are shown in Table 4.

As shown in Table 4, in this example, the initial coating amount of oil was 10 mg (per A-4 size sheet), and image deficiencies, such as oil stripes and oil staining on images, were not generated. However, at a relatively early stage of the endurance test, such as 5,000 sheets, abrasion of the edge portion of the oil control blade occurred, and hence, the amount of the oil was increased to be 60 mg/A-4 sheet, and hence, the quality of fixed images was degraded, and the tactile sensation of the OHP sheet was also degraded.

Comparative Example 4

A mixture was formed of 60 parts by weight of a block copolymer having a viscosity of approximately 30 Pa·s at 25° C. composed of a polyorganosiloxane (a) formed of linear polysiloxane segments each having approximately 300 bifunctional dimethyl siloxane units in series and branched polysiloxane segments, each having one vinyl group, bonded to the two ends of the linear polysiloxane segment and 40 parts by weight of a polyorganosiloxane (b) having a viscosity of approximately 10,000 Pa·s at 25° C. composed of a linear polydimethylsiloxane having vinyl functional groups at the two ends thereof. Next, a polyorganosiloxane (c) having at least two hydrogen atoms bonded to silicone atoms was added as a cross-linking agent to the mixture of the polyorganosiloxanes (a) and (b) so that the number of hydrogen atoms thereof was 1.3 times the total number of vinyl groups contained in the mixture described above. Furthermore, a platinum-based catalyst and 20 parts by weight of high viscous dimethylsilicone oil having a dynamic viscosity of 2,000,000 centistokes were added to the mixture described above, thereby preparing the cross-linkable addition type silicone rubber compound.

By using the cross-linkable addition type silicone rubber compound, an oil coating roller was formed in which the topmost exterior layer contains no inorganic filler, as was the case with Example 4. The tensile strength of the silicone rubber layer was 0.7 MPa. The oil coating roller thus formed was mounted in the oil coating device of the color laser copying machine CLC 700, and endurance test was performed. The results are shown in Table 4.

As shown in Table 4, at a relatively early stage of the endurance test, such as 5,000 sheets, abrasion of the silicone rubber forming the topmost exterior layer occurred, and hence, a number of minute grooves were generated in circumferential directions. Accordingly, since irregularities of oil coating occurred on the images, the oil coating roller could not be sufficient in practical use.

Comparative Example 5

An oil coating roller was formed in a manner equivalent to that in Example 4 except that the oil coating roller used in Example 4 was polished so that the surface roughness Rz thereof was 35 μm. The oil coating roller thus formed was mounted in the oil coating device of the color laser copying machine CLC 700, and endurance test was performed. The results are shown in Table 4.

As shown in Table 4, the coating amount of oil was 60 mg/A-4 size sheet, which was an excessive initial coating amount of oil, and as a result, gummy feeling of the OHP sheet was strong. In addition, the color reproducibility of the fixed images was inferior, and hence, the oil coating roller of this Comparative Example could not be sufficient in practical use.

TABLE 4

| Endurance Test (Sheets) | Coating Oil Amount (mg) | Tactile Sensation of OFP | Accumulated amount of Toner | Image Quality |
|---|---|---|---|---|
| | | Comparative Example 3 | | |
| Initial | 10 | Good | Small | Good |
| 1,000 | 30 | Good | Small | Good |
| 3,000 | 50 | No Good | Small | No Good |
| 5,000 | 60 | No Good | Small | No Good |
| 10,000 | 60 | No Good | Small | No Good |
| 30,000 | 60 | No Good | Small | No Good |
| 50,000 | 60 | No Good | Small | No Good |
| **Endurance Test (Sheets)** | **Initial Coating Oil Amount (mg)** | **Tactile Sensation of OHP** | **Accumulated amount of Toner** | **Image Quality** |
| | | Comparative Example 4 | | |
| Initial | 10 | Good | Small | Good |
| 1,000 | 10 | Good | Small | Good |
| 3,000 | 20 | Good | Small | Good |
| 5,000 | 60/Surface Crack | No Good | Small | No Good |
| 10,000 | — | — | — | — |
| 30,000 | — | — | — | — |
| 50,000 | — | — | — | — |
| | | Comparative Example 5 | | |
| Initial | 60 | No Good | Small | No Good |
| 1,000 | — | — | — | — |
| 3,000 | — | — | — | — |
| 5,000 | — | — | — | — |
| 10,000 | — | — | — | — |
| 30,000 | — | — | — | — |
| 50,000 | — | — | — | — |

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An oil coating roller having a topmost exterior layer composed of a silicone rubber layer comprising a silicone rubber, wherein the tensile strength of the silicone rubber layer is at least 1.0 Mpa, and the silicone rubber layer contains 0 to 0.5 part by weight of an inorganic filler to 100 parts by weight of the silicone rubber.

2. An oil coating roller according to claim 1, wherein the average particle diameter of the inorganic filler is 10 $\mu$m or more.

3. An oil coating roller according to one of claims 1 to 2, wherein the silicone rubber contained in the silicone rubber layer is a cross-linkable addition type silicone rubber.

4. An oil coating roller according to one of claims 1 to 2, wherein the silicone rubber contained in the silicone rubber layer is a cross-linkable organic peroxide type silicone rubber.

5. An oil coating roller according to one of claims 1 to 2, wherein the silicone rubber contained in the silicone rubber layer is a cross-linkable condensation type silicone rubber.

6. An oil coating roller according to one of claims 1 to 2, wherein the silicone rubber contained in the silicone rubber layer is a polymer compound formed by proceeding a cross-link reaction in a mixture comprising a non-linear polyorganosiloxane and a linear polyorganosiloxane.

7. An oil coating roller according to one of claims 1 to 2, wherein the silicone rubber contained in the silicone rubber layer is a polymer compound formed by proceeding a cross-link reaction between a first functional group and a second functional group in a mixture comprising a non-linear polyorganosiloxane having the first functional groups directly bonded to at least two silicone atoms, a linear polyorganosiloxane having the first functional groups directly bonded to silicon atoms at the two ends thereof, and a polyorganosiloxane having the second functional groups directly bonded to at least two silicon atoms.

8. An oil coating roller according to claim 7, wherein the cross-link reaction is an addition type reaction.

9. An oil coating roller according to claim 7, wherein the cross-link reaction is an organic peroxide type reaction.

10. An oil coating roller according to claim 7, wherein the cross-link reaction is a condensation type reaction.

11. An oil coating device comprising:

an oil coating roller having a topmost exterior layer composed of a silicone rubber layer comprising a silicone rubber, wherein the tensile strength of the silicone rubber layer is at least 1.0 Mpa, and the silicone rubber layer is selected from the group consisting of (A), (B) and (C), wherein in (A) the silicone rubber layer contains less than 0.5 parts by weight of an inorganic filler for each 100 parts by weight of silicone rubber, in (B) the silicone rubber layer contains an inorganic filler, wherein the average particle diameter of the inorganic filler is less than 10 $\mu$m, and in (C) the surface roughness (Rz) of the silicone rubber layer is 0.5 to 20 $\mu$m.

12. A fixing apparatus comprising a pair of rotating units for fixing which rotate while pressing each other and form a nip portion at which a transfer medium is pressed and conveyed, at least one of the pair of rotating units provided with a means for coating a releasing agent, in which a developer image formed on the transfer media is fixed thereon as a permanent image by heating and pressing the developer image at the nip portion, comprising an oil coating device according to claim 11.

13. An oil coating device according to claim 11, wherein the average particle diameter of the inorganic filler in silicone rubber layer (A) is 10 $\mu$m or more.

14. An oil coating device according to claim 11, wherein the content of the inorganic filler in silicone rubber layer (B) is not more than 50 parts by weight to 100 parts by weight of the silicone rubber.

15. An oil coating device according to claim 11, wherein the silicone rubber contained in the silicone rubber layer is a cross-linkable addition type silicone rubber.

16. An oil coating device according to claim 11, wherein the silicone rubber contained in the silicone rubber layer is a cross-linkable organic peroxide type silicone rubber.

17. An oil coating device according to claim 11, wherein the silicone rubber contained in the silicone rubber layer is a cross-linkable condensation type silicone rubber.

18. An oil coating device according to claim 11, wherein the silicone rubber contained in the silicone rubber layer is a polymer compound formed by proceeding a cross-link reaction in a mixture comprising a non-linear polyorganosiloxane and a linear polyorganosiloxane.

19. An oil coating device according to claim 11, wherein the silicone rubber contained in the silicone rubber layer is a polymer compound formed by proceeding a cross-link reaction between a first functional group and a second functional group in a mixture comprising a non-linear polyorganosiloxane having the first functional groups directly bonded to at least two silicon atoms, a linear polyorganosiloxane having the first functional groups directly bonded to silicon atoms at the two ends thereof, and a polyorganosiloxane having the second functional groups directly bonded to at least two silicon atoms.

20. An oil coating device according to claim 19, wherein the cross-link reaction is an addition type reaction.

21. An oil coating device according to claim 19, wherein the cross-link reaction is an organic peroxide type reaction.

22. An oil coating device according to claim 19, wherein the cross-link reaction is a condensation type reaction.

* * * * *

UNITED STATES PATENT AND TRADEMARK OFFICE

CERTIFICATE OF CORRECTION

PATENT NO. : 6,424,815 B1
DATED : July 23, 2002
INVENTOR(S) : Hideo Kawamoto et al.

It is certified that error appears in the above-identified patent and that said Letters Patent is hereby corrected as shown below:

Column 11,
Line 51, “an” should read -- a --.
Line 59, “an” should read -- a --.

Column 15,
Line 57, “not” should be deleted.

Signed and Sealed this

Eleventh Day of February, 2003

JAMES E. ROGAN
*Director of the United States Patent and Trademark Office*